US006810666B2

(12) United States Patent
Lutz et al.

(10) Patent No.: US 6,810,666 B2
(45) Date of Patent: Nov. 2, 2004

(54) VARIABLE GEOMETRY TURBINE

(75) Inventors: Ernst Lutz, Wolfhalden (CH); Juerg Spuler, Neukirch (CH)

(73) Assignee: Iveco Motorenforschung AG, Arbon (CH)

( * ) Notice: Subject to any disclaimer, the term of this patent is extended or adjusted under 35 U.S.C. 154(b) by 0 days.

(21) Appl. No.: 10/153,639

(22) Filed: May 24, 2002

(65) Prior Publication Data

US 2003/0010029 A1 Jan. 16, 2003

(30) Foreign Application Priority Data

May 25, 2001 (IT) ..... TO2001A0505

(51) Int. Cl.[7] ..... F01D 17/14; F02D 23/00; F03B 1/04; F04D 29/46

(52) U.S. Cl. ..... 60/602; 415/158; 417/407

(58) Field of Search ..... 60/602; 415/157, 415/158, 159; 417/407

(56) References Cited

U.S. PATENT DOCUMENTS 4,802,817 A 2/1989 Tyler ..... 415/157
5,443,362 A 8/1995 Crites et al. ..... 415/184
6,314,736 B1 * 11/2001 Daudel et al. ..... 60/602
6,443,696 B1 * 9/2002 Erdmann et al. ..... 60/602

FOREIGN PATENT DOCUMENTS

| | | | |
|---|---|---|---|
| EP | 0 034 915 A | 9/1981 | ..... F01D/17/14 |
| EP | 0 654 587 A | 5/1995 | ..... F01D/17/14 |
| EP | 0 678 657 A | 10/1995 | ..... F01D/17/14 |
| GB | 305 214 | 10/1929 | |

* cited by examiner

*Primary Examiner*—Sheldon J Richter
(74) *Attorney, Agent, or Firm*—Finnegan, Henderson, Farabow, Garrett & Dunner, L.L.P.

(57) ABSTRACT

A variable geometry turbine, particularly for a supercharger turbocompressor of an internal combustion engine, comprising an outer housing forming a spiral inlet channel for an operating fluid, a rotor supported in a rotary manner in the housing, and an annular vaned nozzle of variable geometry interposed radially between the channel and the rotor and comprising a control member moving axially in order to control of the flow of the operating fluid from the channel to the rotor, the control member being formed as an annular piston of a fluid actuator actuated directly by means of a control pressure.

13 Claims, 5 Drawing Sheets

VARIABLE GEOMETRY TURBINE

The present invention relates to a variable geometry turbine. The preferred, but not exclusive, field of application of the invention is in superchargers of internal combustion engines, to which reference will be made in the following description in a non-limiting manner.

BACKGROUND OF THE INVENTION

Turbines are known that comprise a spiral inlet channel surrounding the rotor of the turbine and a vaned annular nozzle interposed radially between the inlet channel and the rotor. Variable geometry turbines (VGT) are also known in which the vaned annular nozzle has a variable configuration so that flow parameters of the operating fluid from the inlet channel to the rotor can be varied. According to a known embodiment, the variable geometry nozzle comprises an annular control member moving axially to vary the throat section, i.e. the working flow section, of this nozzle. This annular control member may be formed, for instance, by a vane support ring from which the vanes extend axially and which can move axially between an open position in which the vanes are immersed in the flow and the throat section of the nozzle is maximum, and a closed position in which the ring partially or completely closes the throat section of the nozzle. During the forward movement of the ring, the vanes of the nozzle penetrate through appropriate slots in a housing provided in the turbine housing in a position facing this ring.

The displacement of the annular control member is controlled by means of a control device comprising an actuator external to the turbine, of pneumatic or electrical type, and a kinematic chain of transmission of motion from the actuator to the annular control member of the nozzle. This entails relatively high costs and may limit reliability. In most known solutions, the accuracy of the control is also reduced, since the kinematic chain has significant play which tends to increase during the life of the device as a result of wear. A further drawback connected with known solutions lies in the fact that known control devices require very precise adjustment which is a delicate operation.

SUMMARY OF THE INVENTION

The object of the present invention is to provide a variable geometry turbine with a vaned nozzle provided with an axially moving control member which is free from the drawbacks connected with known turbines and described above.

This object is achieved by the present invention which relates to a variable geometry turbine comprising a housing, a rotor supported in a rotary manner in this housing, the housing defining an inlet channel for an operating fluid in the form of a spiral surrounding the rotor, and an annular vaned nozzle of variable geometry interposed radially between the channel and the rotor and comprising a control member moving axially in order to control of the flow of the operating fluid from the channel to the rotor by varying a throat section of the nozzle, characterised in that the control member is formed as an annular piston of a fluid actuator, the turbine comprising a fluid control line, the control member being actuated directly by means of a control pressure via this fluid control line.

BRIEF DESCRIPTION OF THE DRAWINGS

The invention is described below with reference to a number of embodiments, given by way of non-limiting example, and illustrated in the accompanying drawings, in which.

DETAILED DESCRIPTION OF THE INVENTION

Figure 1:
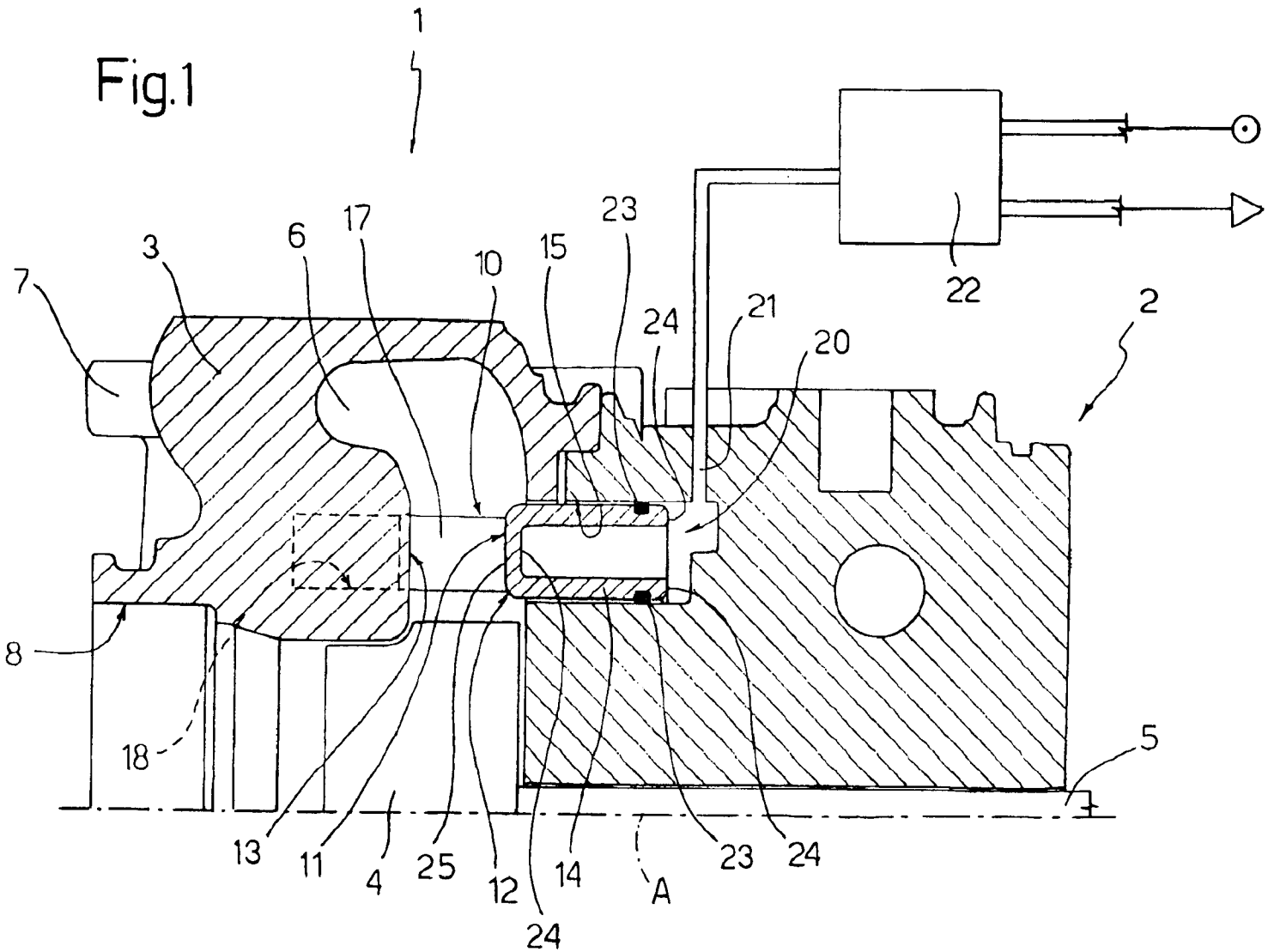
FIG. 1 is a partial axial section through a variable geometry turbine of the present invention.

In FIG. 1, a variable geometry turbine is shown overall by 1; the turbine is advantageously used in a turbocompressor 2 (shown in part) for supercharging an internal combustion engine.

The turbine 1 essentially comprises a housing 3 and a rotor 4 of axis A supported in a rotary manner about the axis A and rigidly connected with a drive shaft 5 of a compressor (not shown). The housing 3 defines, in a known manner, a spiral inlet channel 6 surrounding the rotor 4 and provided with an inlet opening 7 adapted to be connected to an exhaust manifold (not shown) of the engine. The housing 3 further defines an axial outlet duct 8 for the exhaust gases at the outlet of the rotor 4.

The turbine 1 lastly comprises a vaned annular nozzle 10 of variable geometry which is interposed radially between the inlet channel 6 and the rotor 4 and defines a throat section 11, i.e. a working section of minimum flow of the nozzle 10, which can be varied to control the flow of exhaust gases from the inlet channel 6 to the rotor 4.

The nozzle 10 is formed by an axially moving vaned ring 12 bounding the throat section 11 with a wall 13 of the housing 3 axially facing it. More particularly, the vaned ring 12 comprises an annular member 14 mounted in an axially sliding manner in an annular chamber 15 provided in the housing 3 in a position facing the wall 13, and a plurality of vanes 17 extending axially from the annular member 14 and engaging respective slots 18 provided in the wall 13 in an axially sliding manner.

According to the present invention, the annular member 14 forms the piston of a fluid actuator 20, which is advantageously pneumatic, whose chamber 15 defines the cylinder, and is directly actuated by a control pressure pC via a control line 21 provided in the housing 3 of the turbine and communicating with the chamber 15. The control line 21 is connected to a control valve 22, advantageously an electromagnetically controlled proportional valve which is driven by an electronic control unit (not shown) so as to provide a control pressure pC appropriate for the variation of operating parameters of the vehicle, as will be described in further detail below.

The annular member 14, advantageously having a hollow C-shaped section for reasons of weight reduction, co-operates in a leak-tight manner with the chamber 15 by means of sealing members 23 of conventional type. In the embodiment of FIG. 1, the annular member 14 therefore has a control surface 24 subject to the control pressure pC and a reaction surface 25 subject to the pressure of the operating fluid.

In operation, the control pressure pC acts axially on the control surface 24 in the direction of closure of the nozzle 10. The operating fluid of the turbine 1, in particular the exhaust gas, acts on the reaction surface 25 in the opposite direction, i.e. in a direction such as to bring the nozzle 10 towards an open configuration. Any variation of the control pressure pC generates a displacement of the vaned ring 12 until a condition of equilibrium is reset between the control pressure pC and the pressure of the operating fluid. This means that each value of the control pressure pC corresponds to a value of the mean pressure of the operating fluid in the nozzle 10 and therefore of the turbine inlet pressure pT at least until the vaned ring 12 is in contact with a mechanical stop at the end of its stroke. Controlling the control pressure pC is therefore equivalent to controlling the turbine inlet pressure pT which is one of the most important operating parameters of a supercharged engine.

In operation, the operating fluid enters the nozzle 10 in a substantially radial direction from outside, i.e. from the inlet channel 6, and is deflected by the vanes 17 according to their pitch angle to the rotor 4. By means of the axial displacement of the annular member 14, the throat section can be varied from a maximum to a minimum value which may be equal to zero in the maximum closed configuration of the nozzle 10. In operation, this condition causes the flow of operating fluid to stop and may be advantageously used, in an internal combustion engine/turbocompressor system, in the phases of braking with the engine brake, cold starting and emergency stopping of the engine.

Figure 2:
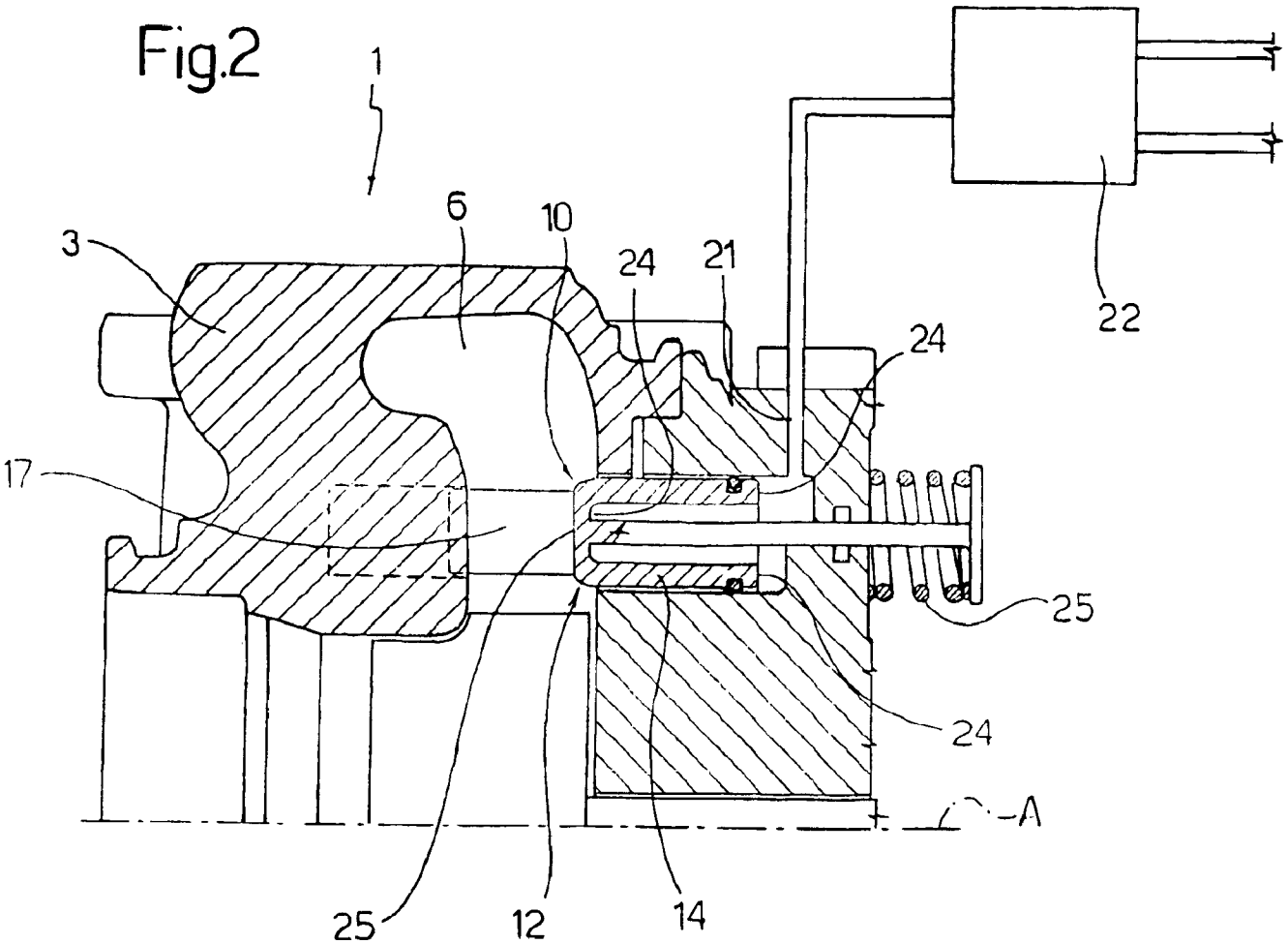
FIGS. 2, 3 and 4 are partial axial sections through variants of the variable geometry turbine of FIG. 1.
Figure 3:
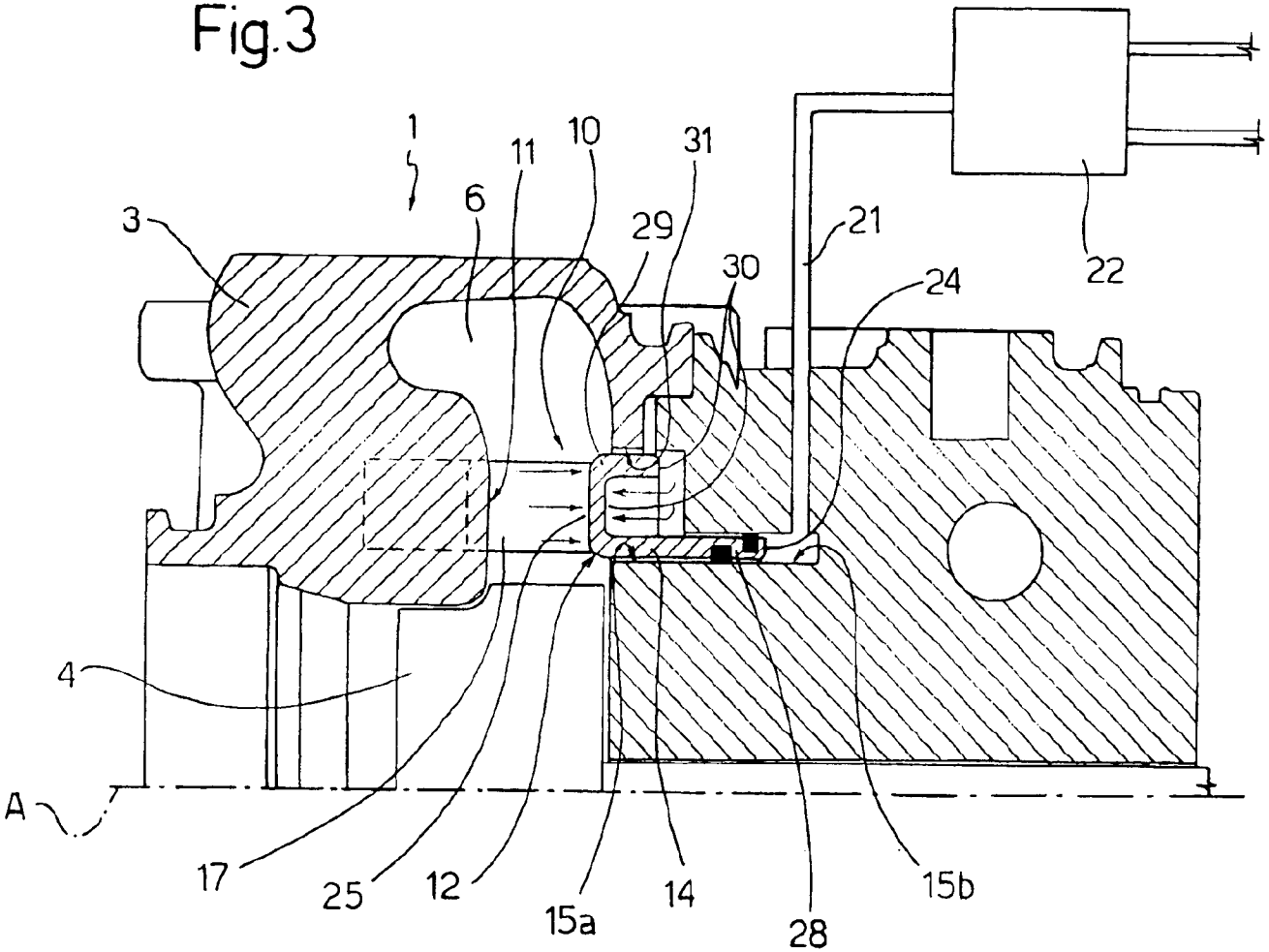
Figure 4:
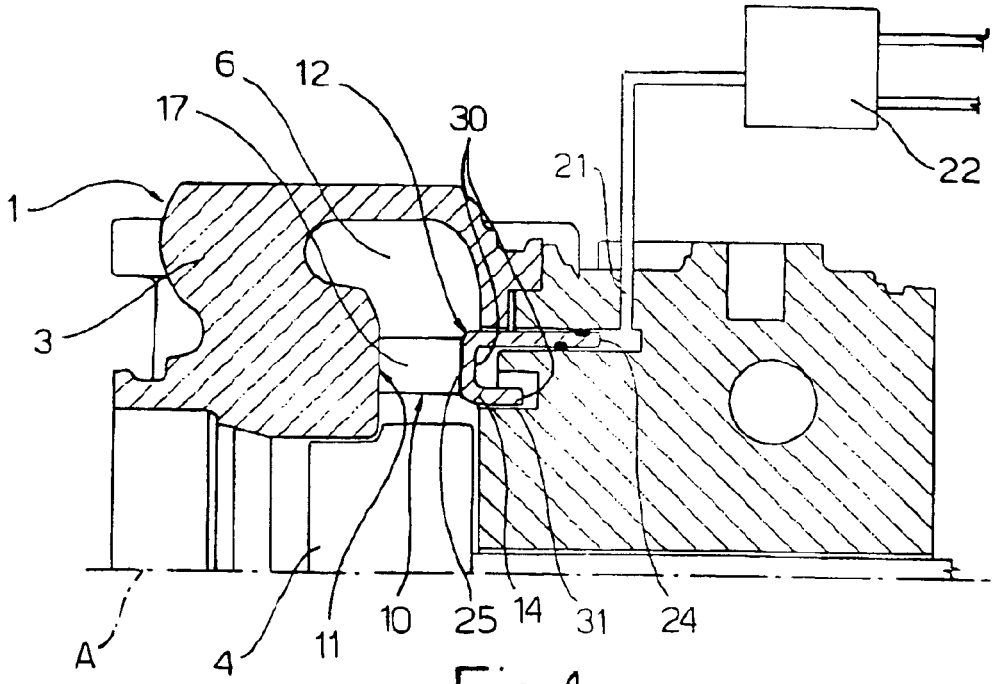

FIGS. 2 to 4 show respective variants of the turbine 1, which are described below with respect to their differences from the turbine 1 of FIG. 1, using the same reference numerals for components identical or corresponding to components already described with reference to FIG. 1.

In the variant of FIG. 2, the vaned ring 12 is subject to the elastic recall force of one or a plurality of recall springs 25 acting in the direction of opening of the nozzle 10, i.e. in opposition to the control pressure pC. The spring 25 improves operating safety as the elastic recall force makes it possible to overcome any frictional resistance that may occur during use. Moreover, the level of the control pressure pC needed for the closure of the nozzle 10 is increased, thereby improving the accuracy of control; it is known in practice that pressure regulator valves do not operate in a precise way at low pressure levels. A further effect of the spring 25 is to reduce the amplitude of the oscillations to which the vaned ring 12 may be subject in use as a result of the pressure pulses of the operating fluid, for instance the exhaust gases of an internal combustion engine.

FIG. 3 shows a variant of the turbine 1 whose chamber 15 has two portions 15*a*, 15*b* axially adjacent to one another and having a different working section: a first portion 15*a* adjacent to the throat section 11 of the nozzle 10 and having a larger working section and a second portion 15*b* communicating with the fluid control line 21 and having a substantially smaller working section.

The annular member therefore has a "stepped" structure and comprises a portion 28 sliding in a leak-tight manner in the second portion 15*b* of the chamber 15 and defining the control surface 24, and a portion 29 sliding in the first portion 15*a* and defining the reaction surface 25. The portion 29 also comprises an auxiliary thrust surface 30 facing the control surface 24 and subject to the pressure of the operating fluid in the nozzle 10 via a passage 31. The pressure of the operating fluid acts on the auxiliary thrust surface 30 simultaneously with the control pressure pC.

In this way, the control fluid flow needed for the displacement of the vaned ring 12 is reduced, making it possible to use a more compact and economic control valve 22.

In the embodiment of FIG. 3, the auxiliary thrust surface 30 is radially external to the control surface 24 and communicates with the nozzle 10 via a passage 31 disposed upstream of the throat section 11 of this nozzle; the auxiliary surface 30 is therefore subject to a pressure greater than the mean pressure acting on the reaction surface 25. In this way, it is possible to reduce the resultant of the pressure forces transmitted by the operating fluid to the ring 12 which acts on the vaned ring 12 in opposition to the control pressure pC up to a value substantially equal to the frictional resistance of the sealing members 23. There is therefore a substantial reduction of the amplitude of the oscillations of the vaned ring 12 resulting from the pressure pulses of the operating fluid.

In the variant of FIG. 4, the auxiliary thrust surface 30 is radially inside the control surface 24 and communicates with the nozzle 10 via a passage 31 disposed downstream of the throat section 11 of this nozzle; the auxiliary surface 30 is therefore subject to a pressure smaller than the mean pressure acting on the reaction surface 25. This solution increases the level of the control pressure pC needed to displace the vaned ring 12, and therefore makes it possible for the control valve 21 to be operated at a greater pressure level, thus obtaining a greater accuracy of control.

Figure 5:
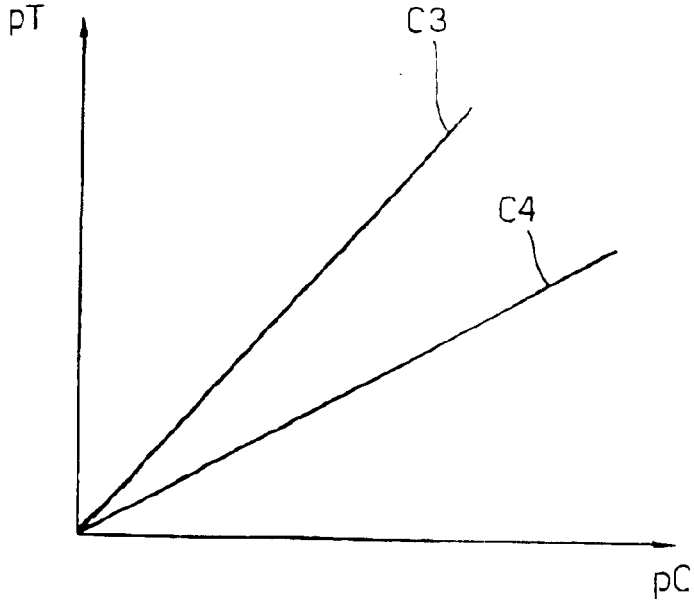
FIG. 5 is a graph showing respective control characteristics of the turbines of FIGS. 3 and 4.

FIG. 5 is a graph in which the control characteristics C3 and C4 of the solutions of FIG. 3 and FIG. 4 respectively are compared. The graph shows the turbine inlet pressure pT (pressure in the inlet channel 6 upstream of the nozzle 10) as a function of the control pressure pC in the line 21. It can be seen from the graph that the turbine inlet pressure pT (on the ordinate) depends in a linear manner on the control pressure pC (on the abscissa) as a result of the principle of the equilibrium of the forces acting on the vaned ring 12 discussed above. It will also be appreciated that the level of control pressure pC, with the same turbine inlet pressure pT, is greater in the case of FIG. 4.

Figure 6:
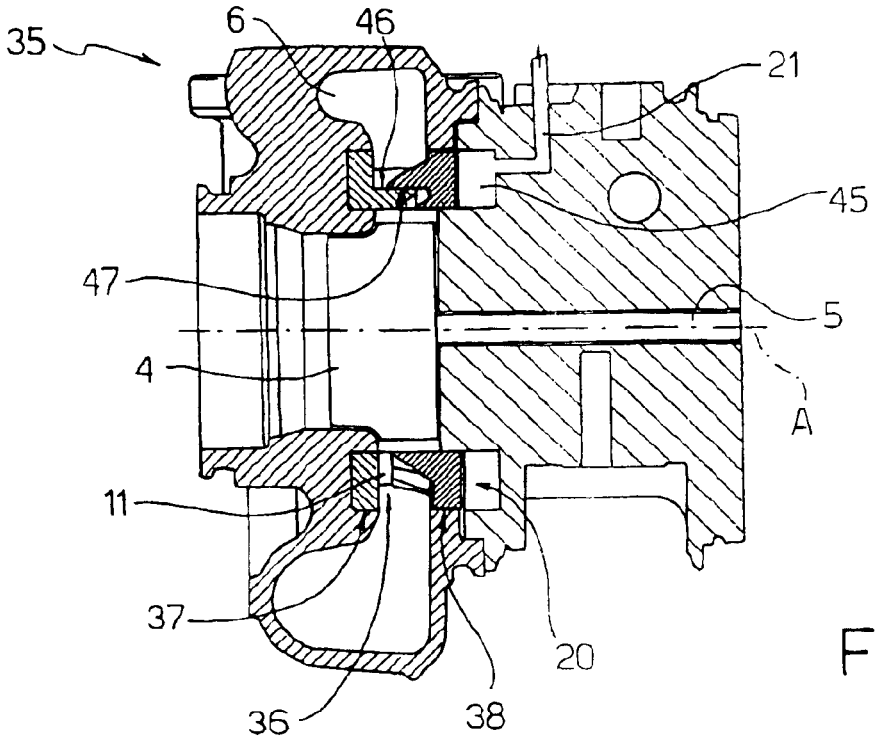
FIG. 6 is an axial section through a further embodiment of a variable geometry turbine of the invention.

FIG. 6 shows a further embodiment of a turbine of the present invention, shown overall by 35.

The turbine 35 differs from the turbines 1 described above in that it comprises a nozzle 36 formed by a pair of vaned rings 37, 38 which face one another axially and axially bound the throat section 11.

The vaned rings 37, 38 each comprise an annular member 39, 40 and a plurality of vanes 41, 42 rigidly connected to the respective annular member 39, 40 and extending towards the annular member 40, 39 of the other vaned ring 38, 37.

The vanes 41, 42 are tapered substantially as wedges such that the two pluralities of vanes 41, 42 can penetrate one another.

The vaned ring 37 is secured to the housing 3 of the turbine 35; the vaned ring 38 can move axially with respect to the ring 37 in order to vary the throat section 11 of the nozzle 36.

According to the invention, the annular member 40 of the vaned ring 38 is disposed to slide in a leak-tight manner in an annular chamber 45 provided in the housing 3 and forms an annular piston of a pneumatic actuator 20 for the control of the throat section 11 of the nozzle 36. The axial position of the vaned ring 38 can therefore be directly controlled by varying the pressure in the chamber 45 in a completely identical manner to that described with respect to the turbines 1.

Figure 7:
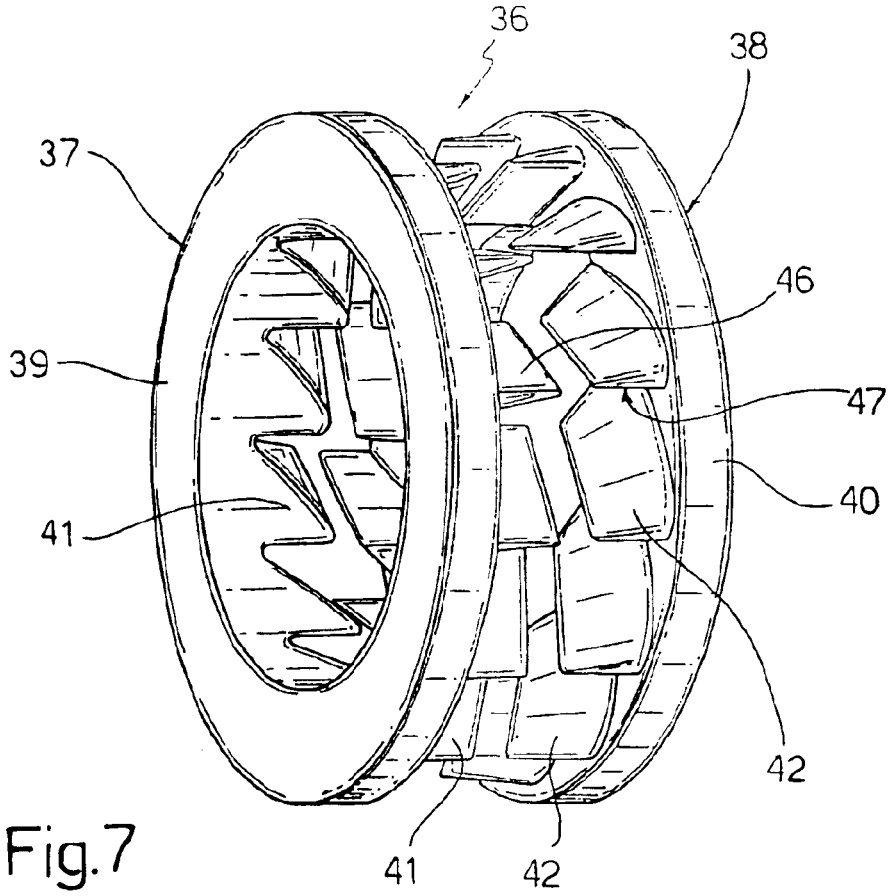
FIG. 7 is a perspective view of a nozzle of the turbine of FIG. 6.

The vanes 41, 42 are shaped so as to mesh with one another in a completely closed configuration of the nozzle 36, in which the vaned ring 38 is in the position of maximum axial advance and is disposed in contact with the vaned ring 37. The vanes 41, 42 (FIG. 7) are disposed in a substantially tangential direction on the respective annular members 39, 40 and have, in a section obtained with a cylinder of axis A, a triangular, and preferably saw-tooth, profile.

Preferably, the vanes 41, 42 are bounded by respective flanks 46, 47 of complementary shape, for instance plane, which are adapted to co-operate with one another to define a predetermined angular position of the vaned ring 38 moving with respect to the fixed vaned ring 37, under the dynamic action exerted by the operating fluid on the vanes 42 of the moving vaned ring 38.

The advantages that can be obtained with the present invention are evident from an examination of the characteristic features of the turbines 1, 35.

In particular, the direct fluid control by the control member of the throat section of the turbine makes it possible to avoid the use of external actuators and related kinematic transmission mechanisms. This provides a variable geometry turbine which is simpler, more economic and more compact; reliability is also increased as the risks of breakdowns of the kinematic transmission mechanism are reduced; the control of the turbine inlet pressure, which is one of the most important parameters in the control of supercharged engines, is lastly particularly simple, reliable and precise.

It will be appreciated lastly that modifications and variations that do not depart from the scope of protection of the claims may be made to the turbines 1, 35 as described.

What is claimed is:

1. A variable geometry turbine comprising:

a housing;

a rotor supported in a rotary manner in said housing, said housing defining a spiral-shaped inlet channel for operating fluid, said inlet channel surrounding said rotor;

a fluid control line;

a fluid actuator;

an auxiliary chamber connection means; and an annular vaned nozzle having a geometry interposed radially between the channel and the rotor, said annular vaned nozzle comprising an axially moving control member and a throat section, said control member being configured to control the flow of the operating fluid from the inlet channel to the rotor by varying said throat section, wherein said control member as constitutes an annular piston of said fluid actuator, and the control member being actuated directly by a control pressure via said fluid control line, wherein the control member further comprises a control surface subject to the control pressure and oriented axially so as to move the control member toward a closed configuration in response to an increase in this control pressure, the control member further having a reaction surface subject to the pressure of the operating fluid in the nozzle and oriented axially in a direction opposite to that of the control surface, and wherein the control member further comprises at least one auxiliary surface oriented axially in the same direction as the control surface, said control member being housed in said auxiliary chamber, and said connection means configured to supply the operating fluid from the annular vaned nozzle to the auxiliary chamber.

2. A turbine as claimed in claim 1, wherein the auxiliary surface is disposed radially outside with respect to the control surface, the connection means communicating with the nozzle upstream of the throat section of the nozzle.

3. A turbine as claimed in claim 1, characterised in that the auxiliary surface is disposed radially outside with respect to the control surface and housing in an auxiliary chamber and connection means for supplying the operating fluid from the nozzle to the auxiliary chamber.

4. A turbine as claimed in claim 1, wherein the control member is axially free, such that the axial position of the control member is defined by the equilibrium of the pressure forces acting thereon.

5. A turbine as claimed in claim 1, characterised in that the turbine further comprises elastic means adapted to urge the control member towards an open configuration of the nozzle.

6. A turbine as claimed in claim 1, characterised in that the annular vane nozzle of variable geormetry comprises a first vaned ring and a second vaned ring facing one another, each of the vaned rings comprising an annular member and a plurality of vanes rigidly connected to the annular member and extending towards the annular member of the other vaned ring, these vanes being tapered substantially as wedges such that the two pluralities of vanes can penetrate one another, at least one of the annular members being axially mobile with respect to the other annular member and formed the control member.

7. A turbocompressor for an internal combustion engine, characterised in that it comprises a variable geometry as claimed in claim 1.

8. A turbine as claimed in claim 1, wherein the control chamber is not in flow communication with the inlet channel.

9. A turbine as claimed in claim 1, further comprising a control chamber, wherein the control surface is subject to the control pressure in said control chamber, and wherein the auxiliary chamber is different from the control chamber.

10. A turbine as claimed in claim 9, wherein the control chamber is not in flow communication with the auxiliary chamber.

11. A variable geometry turbine comprising:

a housing;

a rotor supported in a rotary manner in said housing, said housing defining a spiral-shaped inlet channel for operating fluid, said inlet channel surrounding said rotor;

a fluid control line;

a fluid actuator;

an auxiliary chamber connection means; and an annular vaned nozzle having a geometry interposed radially between the channel and the rotor, said annular vaned nozzle comprising an axially moving control member and a throat section, said control member being configured to control the flow of the operating fluid from the inlet channel to the rotor by varying said throat section, wherein said control member constitutes an annular piston of said fluid actuator, and the control member being actuated directly by a control pressure via said fluid control line, wherein the control member is an annular member provided with a plurality of vanes extending axially, the housing having a plurality of slots for housing the vanes in a closed or partially closed configuration of the nozzle, wherein the control member further comprises a control surface subject to the control pressure and oriented axially so as to move the control member toward a closed configuration in response to an increase in the control pressure, the control member further having a reaction surface subject to the pressure of the operating fluid in the nozzle and oriented axially in a direction opposite to that of the control surface.

12. A method for controlling a turbine inlet pressure in an internal combustion engine supercharged by a turbocompressor, the turbocompressor including a variable geometry turbine having an inlet channel in flow communication with a rotor via a nozzle, the rotor defining an axial direction, the nozzle including a plurality of vanes, the method comprising:

providing the vanes;

providing axially extending slots for slidably receiving the vanes;

providing operating fluid to the inlet channel;

providing a control member having a control surface and a reaction surface oriented axially in a direction opposite to that of (he control surface;

flowing the operating fluid radially inward from the inlet channel to the rotor via the nozzle;

moving the vanes axially within the slots via the control member, the movement of the vanes varying a flow area of the nozzle so as to control the amount of operating fluid flowing through the nozzle, placing a pressure on the reaction surface via the operating fluid; and placing a control pressure on the control surface.

13. The method of claim 12, further comprising a step of providing an auxiliary surface oriented axially in the same direction as the control surface and housed in an auxiliary chamber; and placing an auxiliary pressure on the auxiliary surface via the operating fluid.

* * * * *